United States Patent [19]

Dienes

[11] Patent Number: 5,017,938

[45] Date of Patent: May 21, 1991

[54] UHF-TV BROADCAST SYSTEM HAVING CIRCULAR, NON-COAXIAL WAVEGUIDE TRANSMISSION LINE FOR OPERATION IN THE $TE_{11}$ MODE

[75] Inventor: Geza Dienes, Claremont, Calif.

[73] Assignee: Andrew Corporation, Orland Park, Ill.

[21] Appl. No.: 517,427

[22] Filed: May 1, 1990

Related U.S. Application Data

[63] Continuation of Ser. No. 178,244, Apr. 6, 1988, abandoned.

[51] Int. Cl.[5] ..... H01Q 9/34; H01P 1/162

[52] U.S. Cl. ..... 343/874; 343/890; 333/251

[58] Field of Search ..... 343/890, 891, 874; 333/21 R, 21 A, 251, 242

[56] References Cited

U.S. PATENT DOCUMENTS

| | | | |
|---|---|---|---|
| 2,425,345 | 8/1947 | Ring | 333/21 A |
| 2,438,119 | 3/1948 | Fox | 333/21 A |
| 2,603,709 | 7/1952 | Bowen | 333/21 A |
| 2,603,710 | 7/1952 | Bowen | 333/21 A |
| 2,628,278 | 2/1953 | Zaleski | 333/21 A |
| 2,981,906 | 4/1961 | Turner | 333/251 |
| 3,296,558 | 1/1967 | Bleackley | 333/21 A |
| 4,100,514 | 7/1978 | DiTullio et al. | 333/21 A |
| 4,549,310 | 10/1985 | Woodward | 343/890 |
| 4,599,744 | 7/1986 | Vaughan | 343/890 |
| 4,755,777 | 7/1988 | Cohen et al. | 333/21 A |

*Primary Examiner*—Michael C. Wimer

*Attorney, Agent, or Firm*—Arnold, White & Durkee

[57] ABSTRACT

A UHF-TV broadcast system comprising an antenna mounted on an elevated supporting structure for broadcasting UHF-TV to a prescribed region, and a transmission line having a horizontal run leading to the supporting structure for the antenna, and a vertical run leading to the antenna, the transmission line comprising a circular non-coaxial waveguide having an inside diameter large enough to support the propagation of electromagnetic energy therethrough in at least the circular, non-coaxial $TE_{11}$ mode, and a multiplicity of conductive elements extending transversely across the interior of the waveguide at intervals along the length of the waveguide perpendicular to the electric field vector of $TE_{11}$-mode energy having a desired polarization, for suppressing unwanted $TE_{11}$-mode energy that is cross-polarized relative to the desired polarization.

17 Claims, 2 Drawing Sheets

UHF-TV BROADCAST SYSTEM HAVING CIRCULAR, NON-COAXIAL WAVEGUIDE TRANSMISSION LINE FOR OPERATION IN THE $TE_{11}$ MODE

CROSS REFERENCE TO RELATED APPLICATION

This is a continuation of co-pending application Ser. No. 07/178,244, filed on Apr. 6, 1988, abandoned.

FIELD OF THE INVENTION

The present invention relates generally to UHF-TV broadcast systems utilizing circular waveguide transmission line and, more particularly, to an improved waveguide transmission line for operation in the $TE_{11}$ mode as the dominant mode in such systems.

SUMMARY OF THE INVENTION

It is a primary object of the present invention to provide a UHF-TV broadcast system having an improved circular waveguide transmission line which is capable of transmitting electromagnetic signals in the $TE_{11}$ mode of a prescribed polarization while suppressing unwanted cross-polarized $TE_{11}$ mode energy, thereby avoiding the need for polarization filters in the system. A related object of the invention is to provide such a system which has a high power-handling capacity because it includes neither polarization filters nor coaxial waveguide.

It is another important object of this invention to provide a UHF-TV broadcast system having an improved circular waveguide transmission line which is sufficiently rigid and mechanically rugged that it is not susceptible to deformation by wind forces and/or clamp forces exerted on the exterior of the transmission line, thereby improving the electrical performance of the transmission line and avoiding the need for precision clamps that isolate the waveguide from deforming forces.

Yet another object of this invention is to provide a UHF-TV broadcast system having a circular waveguide transmission line of the foregoing type which has low attenuation levels.

A further object of the invention is to provide such an improved circular waveguide transmission line of the type described above which can be easily and efficiently manufactured at a relatively low cost.

In accordance with the present invention, the foregoing objectives are realized by providing a UHF-TV broadcast system comprising an antenna mounted on an elevated supporting structure for broadcasting UHF-TV to a prescribed region, and a transmission line having a horizontal run leading to the supporting structure for said antenna, and a vertical run leading to said antenna, the transmission line comprising a circular non-coaxial waveguide having an inside diameter large enough to support the propagation of electromagnetic energy therethrough in at least the circular non-coaxial $TE_{11}$ mode, and a multiplicity of conductive elements extending transversely across the interior of said waveguide at intervals along the length of the waveguide perpendicular to the electric field vector of $TE_{11}$-mode energy having a desired polarization, for substantially suppressing unwanted $TE_{11}$-mode energy that is cross-polarized relative to the desired polarization. The waveguide is preferably dimensioned to support the propagation of electromagnetic energy therethrough in both the circular non-coaxial $TE_{11}$ and $TM_{01}$ modes, i.e., the waveguide is overmoded in order that the attenuation of the desired $TE_{11}$ mode is thereby reduced. In the event that the $TM_{01}$ is generated, the transverse conductive elements also reduce that unwanted mode.

BRIEF DESCRIPTION OF THE DRAWINGS

Other objects and advantages of the invention will become apparent upon reading the following detailed description and upon reference to the drawings in which.

Figure 1:
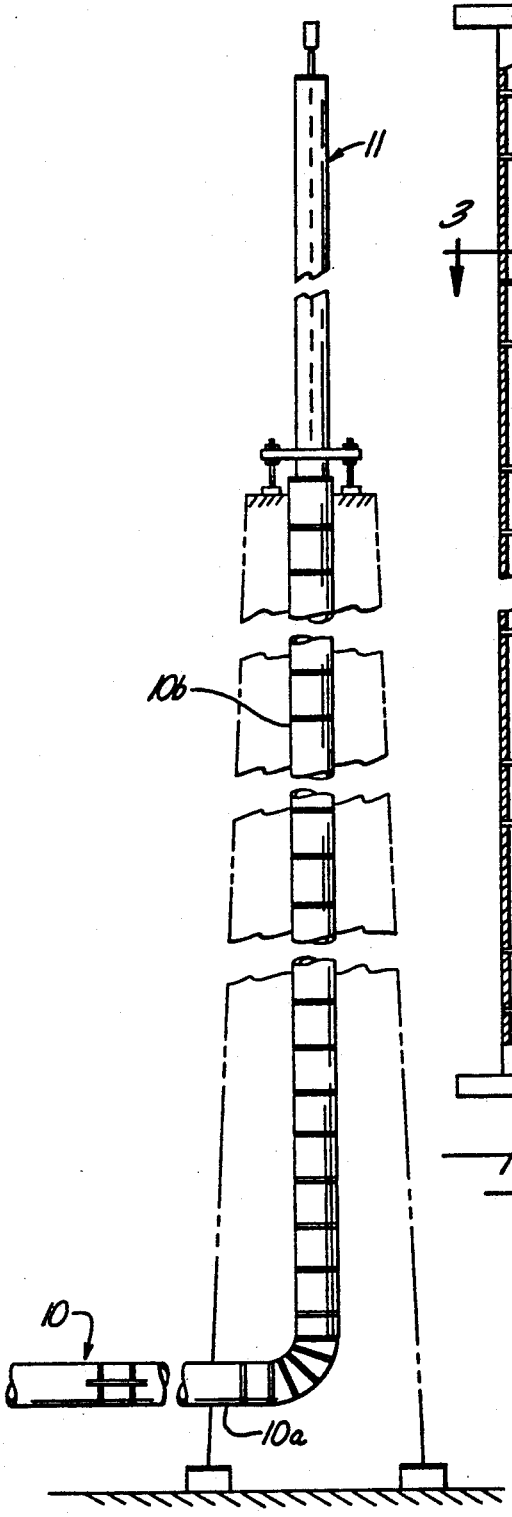
FIG. 1 is a side elevation of a UHF-TV broadcast system embodying the present invention.

While the invention is susceptible to various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring first to FIG. 1, there is shown a UHF-TV broadcast system having a circular waveguide transmission line 10 for supplying signals to an antenna 11 which is typically mounted on the top of a supporting structure such as a tower or tall building. The transmission line 10 includes a horizontal run **10*a* leading to the supporting structure and a vertical run 10*b* leading up to the antenna 11. The antenna 11** may be of the type described in co-pending U.S. patent application Ser. No. 178,246 filed concurrently herewith, now U.S. Pat. No. 4,851,857 and entitled HIGH-POWER, END-FED, NON-COAXIAL UHS-TV BROADCAST ANTENNA.

To protect the antenna from the environment, the conductive portions may be surrounded by a cylindrical radome (not shown) attached to a series of longitudinal ribs (not shown) on the exterior surface of the main body portion of the antenna. The conductive portion of the antenna typically includes a large slotted cylinder in which the arrangement of the slots determines the pattern produced by the antenna, permitting the production of either directional or omnidirectional patterns in the azimuthal plane.

In accordance with one important aspect of the present invention, the inside diameter of the circular waveguide transmission line 10 is large enough to support the propagation of electromagnetic energy therethrough in at least the circular, non-coaxial $TE_{11}$ mode, and a multiplicity of conductive elements extend transversely across the interior of the waveguide at intervals along the length of the waveguide, perpendicular to the electric field vector of the $TE_{11}$-mode energy having a desired polarization. These transverse conductive elements suppress the generation and/or propagation of unwanted $TE_{11}$-mode energy that is cross-polarized relative to the desired polarization.

Even when the transverse elements do not excite the unwanted cross-polarized mode, imperfections in the walls of the waveguide due to manufacturing processes and/or dents produced during handling are often present and can generate the cross-polarized mode. Regardless of where these imperfections occur along the length of the transmission line, the transverse elements provided by this invention quickly suppress any cross-polarized mode and maintain the propagating energy in the desired polarization. Consequently, this transmission line is quite tolerant of imperfections in the waveguide, which is significant in a long, thin-walled structure that is susceptible to damage. The conductive elements assure that only the desired polarization of $TE_{11}$-mode energy is propagated through the waveguide, thereby avoiding the need for any polarization filters in the system.

The resulting transmission line provides a low level of attenuation because the waveguide can be overmoded (which permits the waveguide to have a large diameter), because the transverse conductive elements are present only at spaced intervals along the length of the waveguide, and because no polarization filters are required. Moreover, the transverse conductive elements reduce the susceptibility of the transmission line to deformation by wind loads and clamp forces, thereby improving the electrical performance of the transmission line and avoiding the need for precision clamps that isolate the waveguide from deforming forces. Because the waveguide is non-coaxial, it has a high power capacity.

In the illustrative embodiment FIG. 1, the waveguide transmission line 10 comprises multiple sections of circular waveguide having an inside diameter large enough to support propagation of energy in both the circular non-coaxial $TE_{11}$ and $TM_{01}$ modes. That is, the radius of the inside surface of the waveguide is at least as large as $\lambda/2.613$ (where $\lambda$ is the wavelength at the design frequency of the operating frequency band), which is large enough to support propagation of energy in both the $TE_{11}$ mode and the $TM_{01}$ mode. Thus, the waveguide is overmoded.

Figure 5:
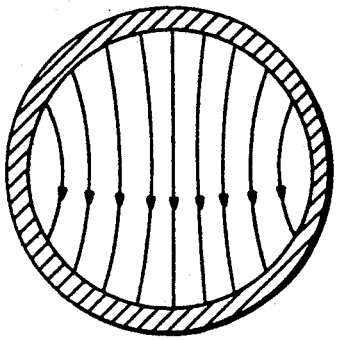
FIG. 5 is an electric vector diagram of the circular non-coaxial $TE_{11}$ mode of energy propagation.
Figure 6:
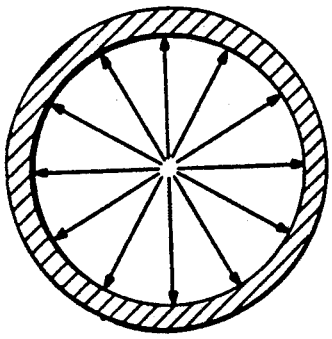
FIG. 6 is an electric vector diagram of the circular non-coaxial $TM_{01}$ mode of energy polarization.
Figure 7:
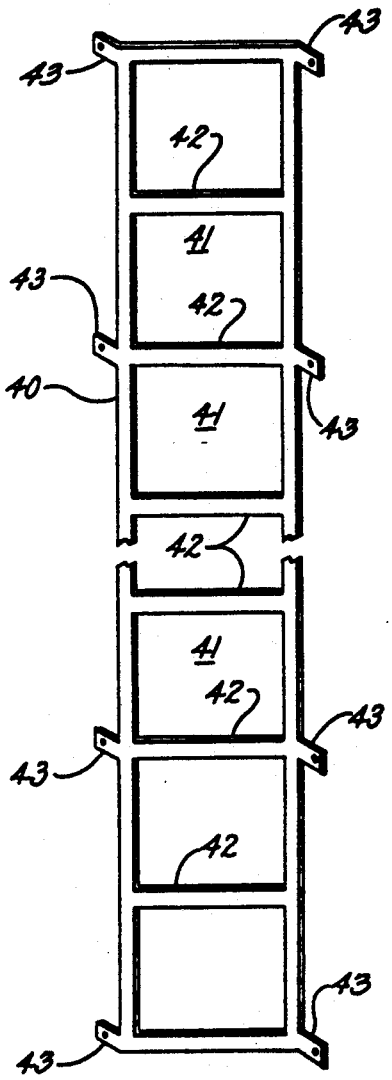
FIG. 7 is a side elevation of a third modified embodiment of the internal structure for use in a section of a waveguide transmission line for use in the system of FIG. 1.

Diagrams of the electric field vectors of the $TE_{11}$ and $TM_{01}$ modes are shown in FIGS. 5 and 6. It can be seen from the vector diagram in FIG. 5 that the $TE_{11}$ mode can have different polarizations; it is desirable, however, to feed the antenna 11 with only a single polarization of $TE_{11}$-mode energy to reliably control the radiation pattern produced by the antenna. The $TM_{01}$ mode is symmetrical about the axis of the waveguide and thus does not have different polarizations.

Figure 2:
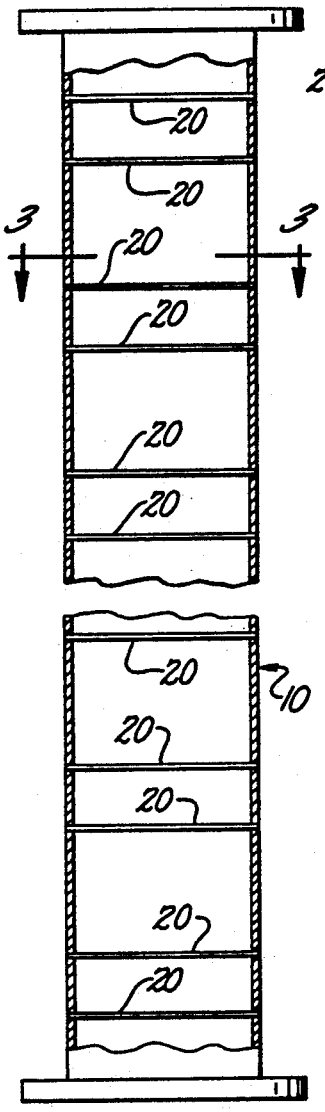
FIG. 2 is an enlarged partial side elevation and partial sectional view of one of the sections of the waveguide transmission line in the system of FIG. 1.
Figure 3:
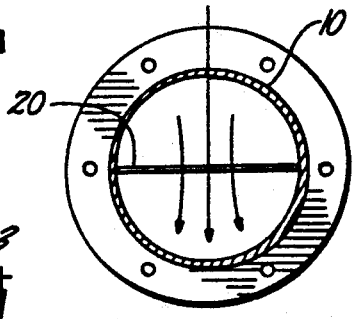
FIG. 3 is a section taken generally along line 3—3 in FIG. 2 with an electric field vector diagram of the circular non-coaxial $TE_{11}$ mode superimposed thereon.

In the embodiment of FIGS. 2 and 3, the transverse conductive elements are in the form of a series of metal pins 20 extending diametrically across the interior of the waveguide, at intervals along the length of the waveguide. To suppress unwanted cross-polarized $TE_{11}$-mode energy, the pins are perpendicular to the electric field vector of $TE_{11}$-mode energy having the desired polarization. The pins 20 are centered within the waveguide to avoid the generation of any significant amount of $TM_{01}$ -mode energy, even though the waveguide is large enough to support the $TM_{01}$ mode. Because the pins extend diametrically across the waveguide, they also tend to reduce any $TM_{01}$ mode that is generated.

The spacing between the pins 20 is wide enough to allow coupling between the fields in the two semi-cylindrical waveguide regions on opposite sides of the pin array, thereby avoiding any reduction in the effective bandwidth of the waveguide due to differential phase delay in the two semi-cylindrical regions. Thus, the spacing between adjacent pins 20 along the axis of the waveguide is preferably a quarter or a half wavelength at the design frequency of the operating frequency band. For example, when the operating frequency band is 622 to 720 MHz, the design frequency is 662 MHz, and the longitudinal spacing between adjacent pins is preferably 6.212 or 12.424 inches in 15-inch diameter waveguide.

The pins 20 may be spaced at non-uniform intervals along the length of the waveguide to reduce the number of pins required. For example, selected pairs of pins can be spaced at a quarter wavelength from each other, and then the pins between successive quarter-wavelength pairs can be spaced more widely, e.g., at a half wavelength. The maximum spacing is limited primarily by the VSWR and ghosting specification for any given system. In general, it is desirable to use the minimum number of pins throughout the entire length of the waveguide so as to minimize the attenuation caused by the pins, without producing unacceptable resonance in the line due to inadequate suppression of unwanted modes. As the number of pins is increased, the suppression of unwanted modes is increased, but attenuation of the desired signals is also increased.

The pins 20 are made of conductive metal and are fastened to the walls of the waveguide s that they reinforce the waveguide and help maintain the desired circular shape of the waveguide. For example, each pin 20 may be inserted through a pair of diametrically opposed holes drilled in the walls of the waveguide, with the opposite ends of each pin being soldered or welded to the waveguide. The waveguide itself is preferably thin-walled, with a maximum thickness of 0.20 inch and a typical thickness of 0.120 inch. The mechanical reinforcement provided by the pins reduces deformation of the circular waveguide due to wind forces and/or clamp forces exerted on the exterior surface of the waveguide, thereby reducing degradation of electrical performance due to such deformation and avoiding the need for costly precision clamps which isolate the waveguide from deforming forces.

It should be appreciated that the pins resist potentially distorting forces not only when such forces are applied to the waveguide in the direction of the pins, but also when such forces are applied in a direction perpendicular to the pins; the latter forces are resisted because the pins prevent the waveguide walls from bulging outwardly, toward an elliptical configuration.

The pins may be straight rods, tubes or formed shapes. Each pin should be thin, preferably less than 1/16 wavelength at the design frequency of the operating frequency band, in the direction of the electric field vector of the $TE_{11}$-mode energy having the desired polarization (see FIG. 3). If desired, the pins may have a larger dimension in the direction of the axis of the waveguide. The pins preferably extend diametrically across the waveguide, but they may be offset slightly from the true diameter of the waveguide if desired or to accommodate manufacturing tolerances.

Figure 4:
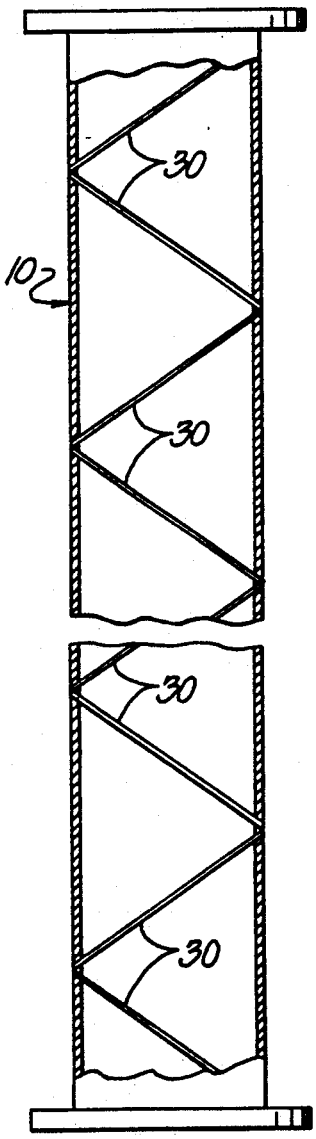
FIG. 4 is a partial side elevation and partial section of a modified embodiment of a waveguide transmission line for use in the system of FIG. 1.

The pins may be arranged perpendicular to the axis of the circular waveguide, as illustrated in FIG. 1, or they may be arranged at acute angles relative to the waveguide axis, as illustrated in FIG. 4. In the arrangement of FIG. 4, adjacent pins 30 are slanted in opposite directions to form an overall zigzag configuration along the length of the waveguide. This zigzag configuration reduces stressing of the pins in response to pressure applied to the exterior surface of the waveguide. With the zigzag configuration of FIG. 4, the spacing between of adjacent pins along the axis of the waveguide is preferably about ¼ wavelength.

As can be seen in FIGS. 2–4, the transmission line 10 comprises a multiplicity of waveguide sections, each of which has a pair of connecting flanges on opposite ends thereof. Each flange has a plurality of bolt holes to permit the flanges of adjacent waveguide sections to be rigidly joined together. To ensure precise alignment of the pins 20 in the adjacent waveguide sections, the flanges are preferably provided with locating means to ensure that the waveguide sections are attached with their respective pins 20 in a common plane. The locating means may take the form of locator holes or other indicia on the two flanges, or the bolt holes themselves may be arranged in an asymmetrical pattern.

FIG. 5 illustrates an alternative to the conductive pins 20. This alternative is less expensive to fabricate, and comprises a one-piece septum 40 having apertures 41 therein. The apertures 41 are about one quarter wavelength wide along the axis of the waveguide. The transverse webs 42 formed between adjacent apertures 41 and at the ends of the septum form the transverse conductive elements. In the particular embodiment illustrated, the longitudinal edges of the septum include multiple pairs of diametrically opposed tabs 43 bent in opposite directions away from the plane of the septum and provided with holes for receiving screws which are threaded through the wall of the waveguide to hold the septum in place within the waveguide.

The transverse conductive elements can be coated with an electrically resistive material such as carbon-loaded fiberglass or ceramic, ferrite-loaded ceramic, or a metalized ceramic. Such a resistive coating quickly dissipates any unwanted energy that is conducted by the transverse conductive elements toward the walls of the waveguide, so that such energy does not produce any undesirable interference or hot spots along the length of the waveguide.

One of the advantages of the pin arrangement shown in FIGS. 2 and 3 is that the pins can be progressively rotated along at least a portion of the waveguide so as to rotate the plane of polarization of the desired $TE_{11}$-mode energy so that such energy can be polarized along different planes. This feature is particularly useful for aligning the plane of the desired polarization within the waveguide with the plane of polarization in the equipment connected to opposite ends of the waveguide. By progressively rotating the pins within the transmission line, at least in the end regions thereof, it is not necessary that the equipment connected to opposite ends of the transmission line have a common plane of polarization.

I claim:

1. A UHF-TV broadcast system, comprising:

an antenna mounted on an elevated supporting structure for broadcasting UHF-TV signals to a prescribed region, a transmission line having a vertical run leading to said antenna, a substantial portion of the vertical run of said transmission line comprising a circular non-coaxial waveguide having a longitudinal axis and having an inside diameter large enough to support the propagation of electromagnetic energy therethrough in at least the circular, non-coaxial $TE_{11}$ mode, said waveguide in the vertical run having side walls constructed such that at least portions thereof would permit the generation of $TE_{11}$ mode energy that is cross-polarized relative to a desired polarization but said side walls would not permit the escape of cross-polarized energy in the non-coaxial $TE_{11}$ mode through said side walls, and a multiplicity of conductive elements extending transversely across the interior of said waveguide portions perpendicular to the electric field vector of $TE_{11}$ mode energy having said desired polarization for suppressing the generation of, rather than removing unwanted $TE_{11}$ mode energy that is cross-polarized relative to said desired polarization said conductive elements being located at intervals along the length of said waveguide portions that would otherwise permit the generation of $TE_{11}$ mode energy that is cross-polarized relative to said desired polarization.

2. The UHF-TV broadcast system of claim 1 which is dimensioned to support the propagation of electromagnetic energy therethrough in both the circular non-coaxial $TE_{11}$ and $TM_{01}$ modes.

3. The UHF-TV broadcast system of claim 1 wherein opposite ends of said conductive elements are rigidly fastened to said circular waveguide to reinforce said waveguide.

4. The UHF-TV broadcast system of claim 3 wherein said circular waveguide has a wall thickness of less than 0.20 inch.

5. The UHF-TV broadcast system of claim 1 wherein said conductive elements are pins arranged perpendicular to the axis of said circular waveguide.

6. The UHF-TV broadcast system of claim 1 wherein the spacing of said conductive elements along the length of said waveguide is selected to minimize the attenuation introduced by said pins.

7. The UHF-TV broadcast system of claim 1 wherein the maximum dimension of the cross section of each of said conductive elements in the direction of the electric vector of said $TE_{11}$-mode energy having said desired polarization is one-sixteenth wavelength at the design frequency of the operating frequency band.

8. The UHF-TV broadcast system of claim 1 wherein the spacing between adjacent conductive elements is great enough to allow coupling between two similar waveguide regions which are located on opposite sides of said elements, thereby avoiding any reduction in the effective bandwidth of said waveguide due to differential phase delay in said two similar waveguide regions.

9. The UHF-TV broadcast system of claim 1 which comprises a plurality of waveguide sections having flange means on the ends thereof for joining successive sections end to end, said flange means including locating means to ensure that said conductive elements in adjacent waveguide sections lie in a common plane.

10. The UHF-TV broadcast system of claim 1 wherein said conductive elements extend diametrically across the interior of said waveguide.

11. The UHF-TV broadcast system of claim 1 wherein said conductive elements have an electrically resistive material thereon.

12. The UHF-TV broadcast system of claim 1 wherein said conductive elements are pins extending at an acute angle to the axis of said circular waveguide.

13. The UHF-TV broadcast system of claim 1 wherein said conductive elements are formed by an apertured septum.

14. A UHF-TV broadcast system, comprising:

an antenna mounted on an elevated supporting structure for broadcasting UHF-TV signals to a prescribed region, a transmission line having a vertical run leading to said antenna, a substantial portion of the vertical run of said transmission line comprising a circular non-coaxial waveguide having a longitudinal axis and having an inside diameter large enough to support the propagation of electromagnetic energy therethrough in at least the circular, non-coaxial $TE_{11}$ mode, said waveguide in the vertical run having side walls constructed such that at least portions thereof would permit the generation of $TE_{11}$ mode energy that is cross-polarized relative to a desired polarization but said side walls would not permit the escape of cross-polarized energy in the non-coaxial $TE_{11}$ mode through said side walls, and a multiplicity of conductive elements extending transversely across the interior of said waveguide portions perpendicular to the electric field vector of $TE_{11}$ mode energy having said desired polarization for suppressing the generation of, rather than removing, unwanted $TE_{11}$ mode energy that is cross-polarized relative to said desired polarization, said conductive elements being located at non-uniform intervals along the length of said waveguide portions that would otherwise permit the generation of $TE_{11}$ mode energy that is cross-polarized relative to said desired polarization.

15. A UHF-TV broadcast system, comprising:

an antenna mounted on an elevated supporting structure for broadcasting UHF-TV signals to a prescribed region, a transmission line having a horizontal run leading to the supporting structure for said antenna, and a vertical run leading to said antenna, a substantial portion of the vertical run of said transmission line comprising a circular non-coaxial waveguide having a longitudinal axis and having an inside diameter large enough to support the propagation of electromagnetic energy therethrough in at least the circular, non-coaxial $TE_{11}$ mode, at least portions of said waveguide in the vertical run having side walls constructed such that they would permit the generation of $TE_{11}$ mode energy that is cross-polarized relative to a desired polarization, and a multiplicity of conductive elements extending transversely across the interior of said waveguide perpendicular to the electric filed vector of $TE_{11}$ mode energy having said desired polarization for suppressing the generation of unwanted $TE_{11}$ mode energy that is cross-polarized relative to said desired polarization, alternating pairs of said conductive elements are spaced apart by one quarter wavelength, then one half wavelength, then one quarter wavelength, etc. along the length of said waveguide portions that would otherwise permit the generation of $TE_{11}$ mode energy that is cross-polarized relative to said desired polarization.

16. A method for broadcasting UHF-TV signals to a prescribed region using an antenna mounted on an elevated supporting structure, the method comprising the steps of:

providing a transmission line having a vertical run with side walls leading to said antenna, a substantial portion of the vertical run of said transmission line comprising a circular non-coaxial waveguide having a longitudinal axis and having an inside diameter large enough to support the propagation of electromagnetic energy therethrough in at least the circular, non-coaxial $TE_{11}$ mode; and using the combination of the vertical run and a multiplicity of conductive elements extending transversely across the interior of and located at intervals along the length of said waveguide portion perpendicular to the electric field vector of $TE_{11}$ mode energy having a desired polarization, sending the $TE_{11}$ mode energy having said desired polarization through the vertical run to the antenna while preventing the $TE_{11}$ mode energy having said desired polarization from transforming into $TE_{11}$ mode energy that is cross-polarized relative to said desired polarization so that none of said $TE_{11}$ mode energy must be removed through said side walls.

17. A UHF-TV broadcast system, comprising:

an antenna mounted on an elevated supporting structure for broadcasting UHF-TV signals to a prescribed region, a transmission line having a vertical run leading to said antenna, a substantial portion of the vertical run of said transmission line comprising a circular non-coaxial waveguide having a longitudinal axis and having an inside diameter large enough to support the propagation of electromagnetic energy therethrough in at least the circular, non-coaxial $TE_{11}$ mode, said waveguide in the vertical run having side walls constructed such that at least portions thereof are susceptible to deformation yet prevent the escape of any $TE_{11}$ mode energy through said side walls; and a multiplicity of conductive elements, extending transversely across the interior of and located at intervals along the length of said waveguide portions perpendicular to the electric field vector of $TE_{11}$ mode energy having a desired polarization, for suppressing the generation of, rather than removing, unwanted $TE_{11}$ mode energy that is cross-polarized relative to said desired polarization.

* * * * *